US008453984B2

(12) United States Patent
Best et al.

(10) Patent No.: US 8,453,984 B2
(45) Date of Patent: Jun. 4, 2013

(54) INSTRUMENT STAND FOR ATTACHMENT TO A WIRE GRILL SURFACE OR THE LIKE

(75) Inventors: Jim Best, Hewitt, NJ (US); Todd Brunner, Brooklyn, NY (US); Marco Perry, Brooklyn, NY (US)

(73) Assignee: Helen of Troy Limited, Belleville, St. Michael (BB)

( * ) Notice: Subject to any disclaimer, the term of this patent is extended or adjusted under 35 U.S.C. 154(b) by 210 days.

(21) Appl. No.: 12/381,182

(22) Filed: Mar. 9, 2009

(65) Prior Publication Data

US 2010/0224752 A1 Sep. 9, 2010

(51) Int. Cl.
*A47B 96/00* (2006.01)

(52) U.S. Cl.
USPC ..... 248/225.21; 248/214; 248/222.12; 248/215; 24/458; 24/457; 224/560; 224/561

(58) Field of Classification Search
USPC ..... 248/316.7, 316.2, 316.3, 222.12, 248/222.13, 222.11, 221.11, 346.07, 241, 248/242, 243, 245, 215, 227.2, 227.4, 227.1, 248/225.21, 305, 231.81, 506, 220.42, 220.43, 248/220.31, 220.41, 223.31; 24/457, 458; 224/560, 561
See application file for complete search history.

(56) References Cited

U.S. PATENT DOCUMENTS 1,256,377 A * 2/1918 Salles ..... 248/214
1,357,893 A 11/1920 Northrop
1,458,168 A 8/1921 Day
1,851,212 A * 3/1932 Ragsdale ..... 244/132
1,926,808 A 9/1933 Hastings
D100,711 S 8/1936 Guild
2,144,885 A * 1/1939 MacFadden ..... 248/222.12
2,216,886 A * 10/1940 Langelier ..... 248/311.2
2,447,382 A 8/1948 Whither
2,467,604 A * 4/1949 Tinnerman et al. ..... 403/387
2,563,749 A 8/1951 Rose et al.
2,616,142 A * 11/1952 Tinnerman ..... 24/662
2,618,033 A * 11/1952 Tinnerman et al. ..... 248/68.1
2,692,414 A * 10/1954 Poupitch ..... 24/293
2,915,272 A * 12/1959 Sislik ..... 248/222.12
3,127,114 A * 3/1964 Shaw ..... 362/98
3,154,281 A * 10/1964 Frank ..... 248/201
3,260,490 A * 7/1966 Trautner ..... 248/480
3,394,593 A 7/1968 Aldridge et al.
3,423,055 A * 1/1969 Fisher ..... 248/73
3,501,117 A * 3/1970 Soltysik ..... 248/71
4,142,703 A * 3/1979 Moretto ..... 248/214
4,449,765 A * 5/1984 Lampman ..... 312/311
4,723,749 A * 2/1988 Carraro et al. ..... 248/317
4,746,225 A 5/1988 Ashe
4,762,237 A * 8/1988 Newton ..... 211/115
5,539,962 A * 7/1996 Lee ..... 24/453
D383,682 S 9/1997 Swanson
6,055,755 A * 5/2000 Prokes ..... 40/617
6,367,220 B1 * 4/2002 Krause et al. ..... 52/512
D477,784 S 7/2003 Wang et al.

(Continued)

*Primary Examiner* — Kimberly Wood

(57) ABSTRACT

The instrument stand, which supports an instrument on a wire rack or similar surface, includes a body, a biasing element and a hook member. The stand is capable of connecting to an instrument, and the biasing element, preferably formed by at least two legs, is also connected to the body, wherein when contacting a surface the legs bias the body in a direction opposite the surface. The hook member connects to one of either a leg or the body, such that the hook member is capable of engaging the surface to thereby oppose the bias by the legs.

21 Claims, 5 Drawing Sheets

U.S. PATENT DOCUMENTS

| | | | | |
|---|---|---|---|---|
| 6,643,900 | B2 * | 11/2003 | Jahrling | 24/563 |
| 6,698,700 | B2 * | 3/2004 | Moerke et al. | 248/220.31 |
| 7,182,299 | B2 * | 2/2007 | Takeuchi | 248/71 |
| 7,468,491 | B2 * | 12/2008 | Deciry et al. | 174/480 |
| 7,523,897 | B2 * | 4/2009 | Boltz et al. | 248/71 |
| 7,708,491 | B2 * | 5/2010 | Quertelet et al. | 403/346 |
| 7,946,549 | B2 * | 5/2011 | Forrest et al. | 248/249 |
| 8,157,235 | B2 * | 4/2012 | Quertelet et al. | 248/339 |
| 2003/0111978 | A1 | 6/2003 | Wang | |
| 2003/0112846 | A1 | 6/2003 | Murtagh | |
| 2003/0218445 | A1 | 11/2003 | Behar | |
| 2007/0139002 | A1 | 6/2007 | Chao et al. | |
| 2008/0143293 | A1 | 6/2008 | Magalhaes | |
| 2008/0207276 | A1 | 8/2008 | Burrell | |
| 2010/0084520 | A1 * | 4/2010 | Ohno | 248/74.1 |

* cited by examiner

INSTRUMENT STAND FOR ATTACHMENT TO A WIRE GRILL SURFACE OR THE LIKE

TECHNICAL FIELD OF THE INVENTION

The present device relates to a stand or support for an instrument. Particularly, the present device relates to a stand for removably securing a parameter measuring device, such as a thermometer or other meter or gauge, to a wire rack, grill, or single bar.

BACKGROUND OF THE INVENTION

Measuring devices often need to be removably attached to fixed objects, where they can be placed closer to the measurement target in order to acquire accurate measurements while still allowing disposability of the instrument or recalibration of the instrument. For example, bakers use thermometer mounting devices, which removably attach to an oven rack, to ensure the oven is accurately heating to the temperature determined by the external temperature dial; however, the instrument may need to be moved within the oven or replaced occasionally.

For such instruments to be most effective, they must be viewable from a small window in the oven door. Fixed, immovable instruments may often be blocked by pans or the like. Frequent adjusting of the cooking racks may also create issues for viewing a fixed instrument.

In addition, for food quality control purposes, commercial refrigeration units or warming/cooling chambers, such as commonly used in restaurants and food storage facilities, often require monitoring of parameters to ensure that the ambient of the unit or chamber is within acceptable parameters. These commercial units and chambers often have wire rack shelving or an equivalent surface within which because of the uneven-ness of the surfaces, do not provide the best placement of prior art instruments.

The device of the present application solves these and other problems of prior art instrument stands used in the industry. An instrument stand which is readily viewable, movable and detachable from within a controlled environment, such as an oven or freezer, is disclosed herein.

SUMMARY OF THE INVENTION

There is disclosed herein an improved instrument stand which avoids the disadvantages of prior devices while affording additional structural and operating advantages.

In general terms the instrument stand comprises a body, a biasing element, and at least one hook member. The body is capable of connecting to the instrument and the biasing element is connected to the body, wherein the biasing element biases the body in a direction of support. The hook member is either connected to the biasing element or the body, and in both cases, the hook member opposes the direction of bias by the biasing element.

In certain specific embodiments of the present invention, it is envisioned that the instrument stand, which supports an instrument on a wire rack or similar surface, comprises a body capable of connecting to an instrument, at least two legs connected to the body, wherein when contacting a surface the legs bias the body in a direction opposite the surface, and a hook member connected to one of either a leg or the body, wherein the hook member is capable of engaging the surface to thereby oppose the bias by the legs.

In an embodiment of the invention, the stand does not have an instrument attached, but such is attachable and detachable.

In other embodiments, the instrument is permanently affixed. In addition, the instrument stand can also be constructed of two, individual pieces. In another embodiment of the present invention there is an instrument stand for holding an instrument, the instrument stand comprising a first body, a second body, a biasing element, and at least one hook member. Both the first body and second bodies are capable of connecting to the instrument. The biasing element is connected to the first body and biases the first body in a direction, and the hook member is connected to the second body and opposes the direction of bias by the biasing element. Additional embodiments also envision the instrument stand being sold along with an instrument.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
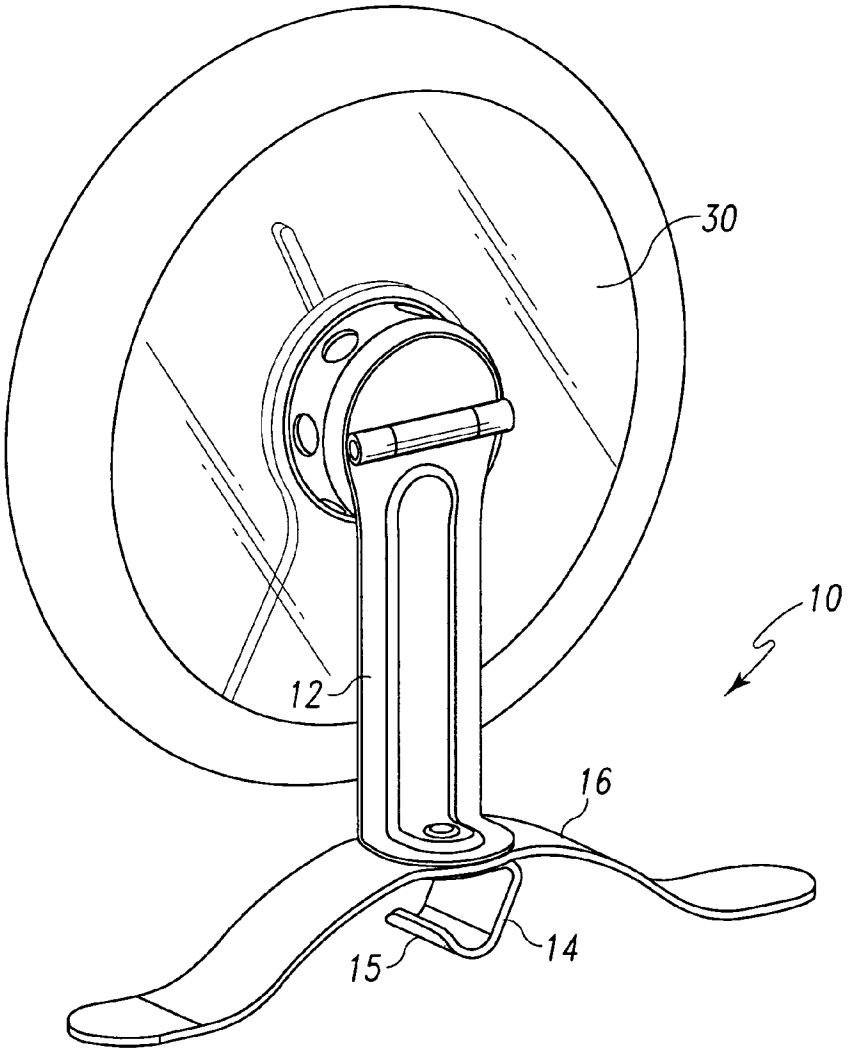
FIG. 1 is a back view according to one embodiment of the present invention.
Figure 2:
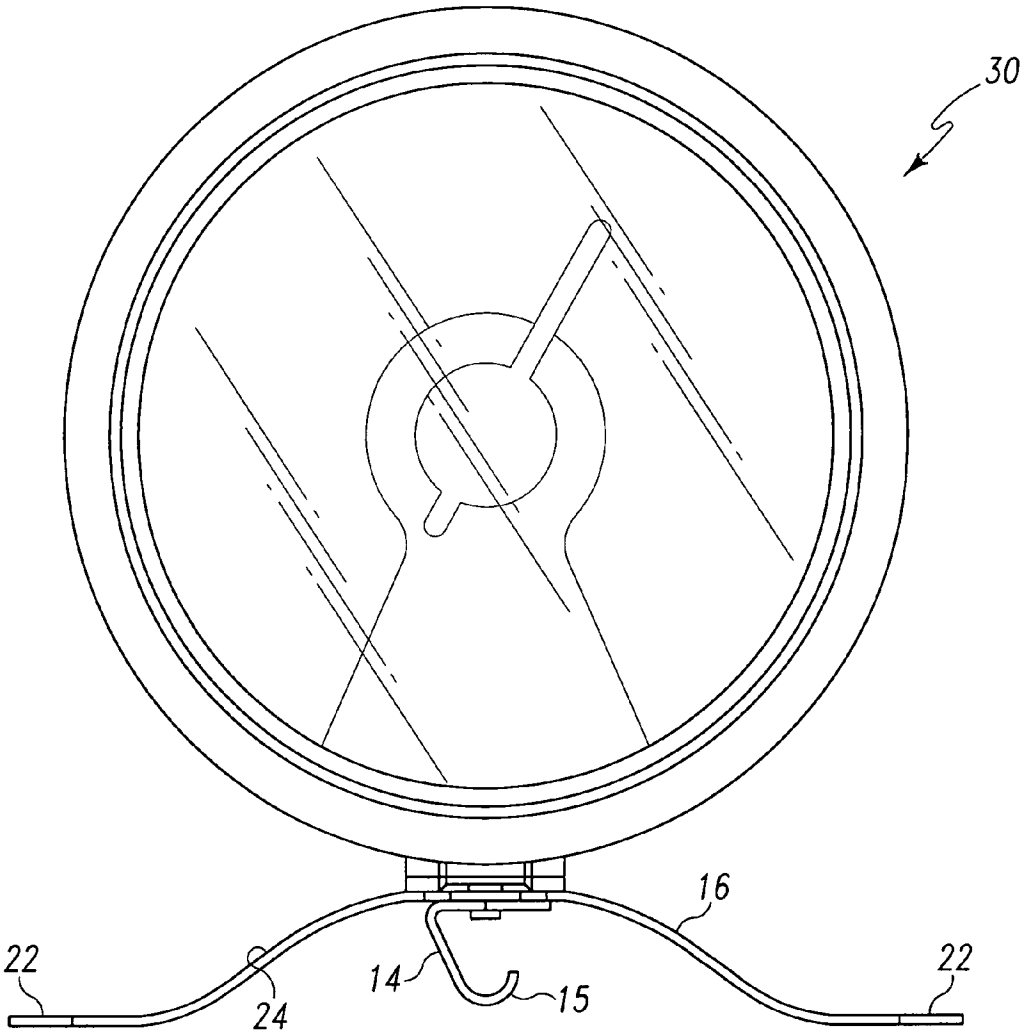
FIG. 2 is a front view according to a second embodiment of the present invention.
Figure 3:
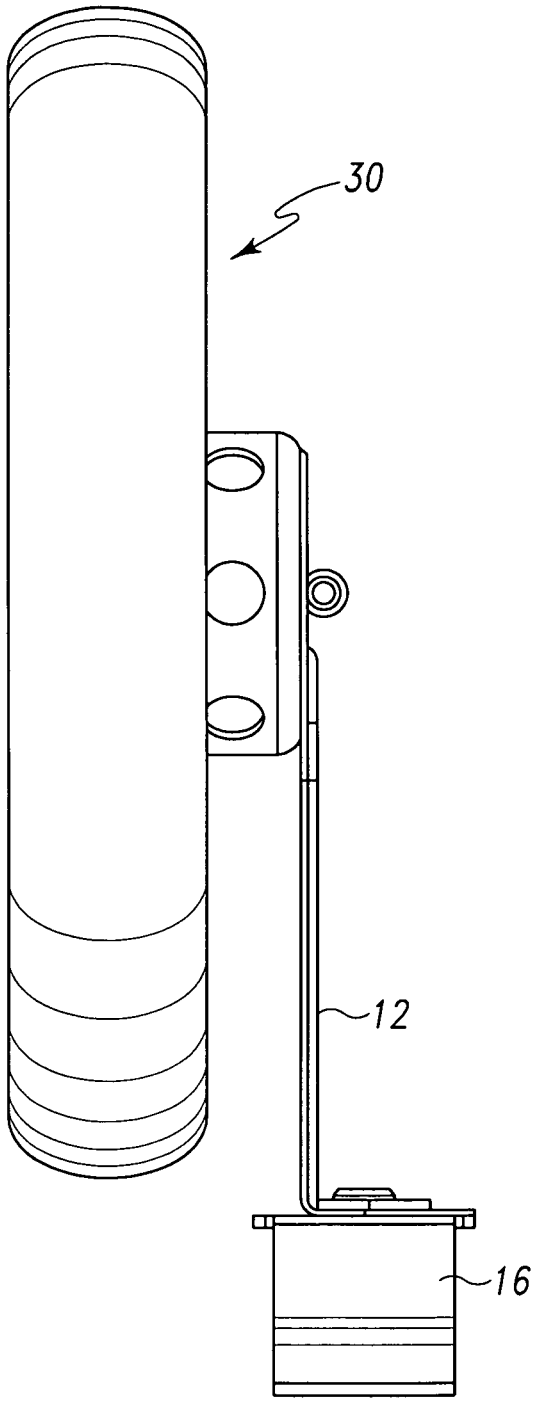
FIG. 3 is a side view of FIG. 1.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

By "instrument" it is meant a device used to measure some environment condition, such as temperature, pressure, humidity, vibration, time, etc., and having a viewable display, such as a digital or analog meter. The instrument is shown to be a circular analog gauge, but may be most any shape, size and electronic configuration. The actual instrument forms no part of the invention other than to be capable of attachment to the disclosed stand in any known manner.

By "surface" it is meant an area upon which the disclosed instrument stand is positioned. In the most common cases, the surface will be a wire grate or rack used commonly in ovens, grills, refrigerators, and freezers for supporting food and the like. Other non-wired areas may be suitable with only minor variations to the disclosed invention.

Referring to FIGS. 1-4, there is illustrated an instrument stand, generally designated by the numeral 10. Referring to FIG. 1, there is illustrated instrument stand 10 made in accordance with an embodiment of the present invention. Instrument stand 10 typically includes a body 12, a biasing element 16 which is connected to body 12, and a hook member 14 that is connected to the body 12 through the biasing element 16, as shown. The connection point for the two components to the body 12 are at least aligned, and preferably the same (i.e., use of a single connector to affix both components to the body). In some situations it may be desired to connect the hook member 14 directly to the body 12 instead, of connecting the hook member 14 through the biasing element 16, which is also connected to body 12. In such embodiments, the two components would probably be offset from one another.

Still referring to FIG. 1, body 12 serves as a means of attaching the remaining elements of instrument stand 10 to an instrument. In the embodiment shown in FIG. 1, body 12 is an elongated bar that in some situations may include a hole, which is used to attach the biasing element 16, via a bolt, rivet, clasp or the like.

Another attachment point is located on the opposite end of the body 12 and is used to attach an instrument 30. Alternatively, the body 12 may have a surface that allows for gluing or welding the body 12 to both the biasing member 16 (including the hook member 14) and the instrument 30. The body 12 may also include an instrument case (not shown) or enclosure (not shown) at one end which is used to encapsulate the instrument 30. As shown in FIG. 1, the body 12 attaches to the back surface of the instrument 30 to best support the instrument for viewing.

Biasing element 16, which is connected to body 12, is used to bias the body 12 in a direction. In the illustrated embodiment, the biasing element 16 is preferably two identical legs extending from the connection point to the body 12. The legs are preferably integral to one another, being formed from a single piece of steel or the like, but may be configured in any number of ways to bias the body 12 and attached instrument 30 from a surface. In the particular embodiment shown in FIG. 1, biasing element 16 creates a bias generally toward the body 12 and away from the surface (see FIGS. 4A-4B).

The instrument stand 10 may be mounted to a horizontal surface, as in a standard kitchen oven, or in other situations to a slanted or completely vertical surface—e.g., an angled display surface in a freezer or refrigerated enclosure or a side surface to prevent taking up horizontal storage space. As pictured in FIG. 1, the biasing element 16 is shaped as a low arch with small "feet" 22 at each end. The feet 22 are used to make contact with the surface while the legs 24, preferably made out of a spring steel, bias the body 12 and supported instrument 30. However, biasing element 16 can be made of any material in several alternate configurations which would provide even a slight resiliency. The resilient property can even be created by using a material that is not generally thought of as resilient, i.e., a ridged material, by adjusting the thickness and the shape of the ridged material used.

Figure 4A:
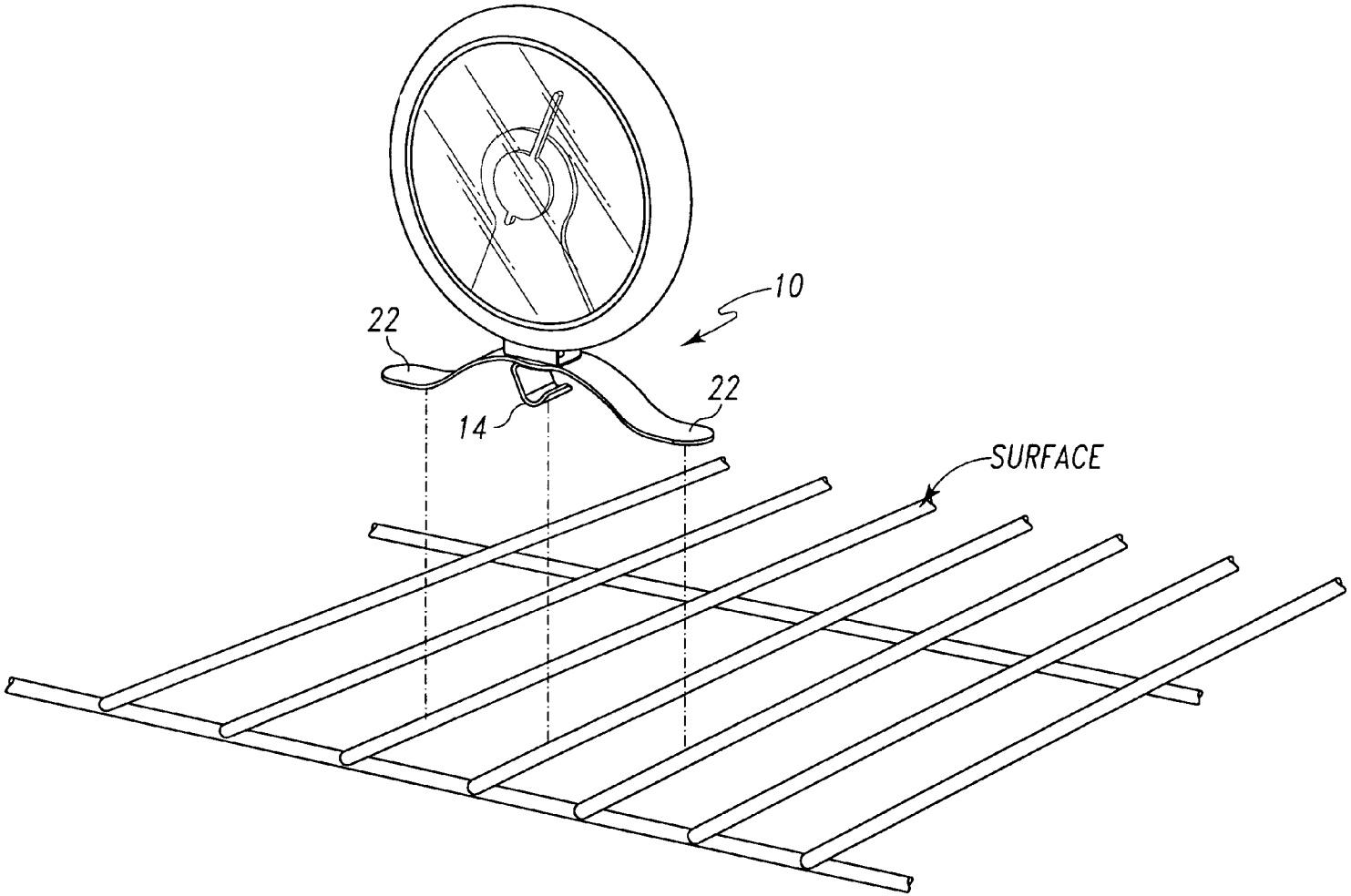
FIGS. 4A and 4B are front views of the embodiment of FIG. 1 showing the present invention secured to a portion of a wire rack.
Figure 4B:
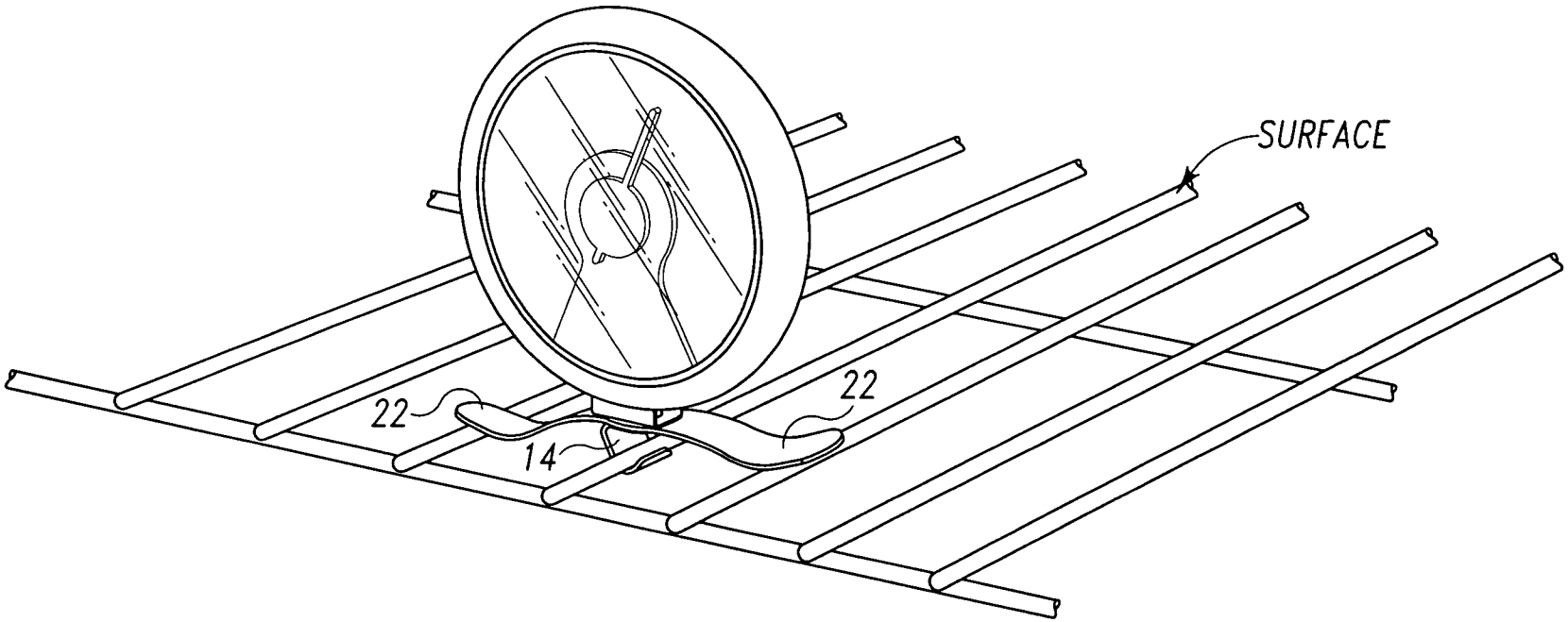

In use, with reference to FIGS. 4A and 4B, the stand 10 can be readily placed onto the surface by first contacting the feet 22 with wire members. Then, by continuing to press against the surface, the hook member 14 can be engaged with another wire member of the surface with a slight shift of the entire stand 10.

Additionally, the hook member 14 is preferably attached as shown in FIG. 1, at a point through biasing element 16. The shape of the hook member 14 is best having a sloped leading face 15 such that contact with a wire member applies a lateral force to the hook member 14. Accordingly, the attachment point should allow the hook member 14 to deflect slightly as the hook member 14 engages the wire member—i.e., without movement of the entire stand 10. Once the hook member opening is reached, the deflected hook member 14 quickly returns to engage the wire member.

To remove the stand 10, the hook member 14 is disengaged by pressing the stand 10 toward the surface and shifting the stand 10 to move the hook member 14 out of engagement with the wire member. Then, lifting the stand 10 away from the surface, removal is complete.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. An instrument stand for supporting an instrument on an associated wire rack, the instrument stand comprising:
- a body adapted to be connected to the instrument;
- a biasing element connected to the body, wherein when contacting a surface of the associated wire rack the biasing element biases the body in a direction opposite the surface, wherein the biasing element is configured to bias against a first wire and a third wire of the associated wire rack; and
- a hook member connected to the body by a fastener, wherein the hook member includes a leading face portion extending at an angle from either the biasing element or the body, and a round portion extending from the leading face portion, the round portion is adapted to hook to the associated wire rack on an arcuate surface of the round portion to thereby oppose the bias by the biasing element, wherein the hook member is configured to hookingly engage a second wire of the associated wire rack, wherein the second wire is disposed between the first wire and the third wire.

2. The instrument stand of claim 1, wherein the biasing element comprises at least two legs.

3. The instrument stand of claim 2, wherein the hook member is connected to one of the at least two legs.

4. The instrument stand of claim 1, wherein the biasing element extends radially outward in two directions from a connection to the body.

5. The instrument stand of claim 4, wherein the biasing element extends radially outward in at least two directions from the connection at an angle of at least 30 degrees measured between adjacent radial extensions of the biasing element.

6. The instrument stand of claim 1, wherein the hook member is connected to a position opposite a connection for the instrument.

7. The instrument stand of claim 1, wherein the leading face portion is a sloped face to deflect the hook member when engaging the surface.

8. The instrument stand of claim 1, wherein a lower surface of the hook member is positioned above the lower surface of each foot when the instrument stand is not secured to the associated wire rack.

9. An instrument stand for supporting an instrument on an associated wire rack, the instrument stand comprising:
- a body configured to connect to the instrument;
- a biasing element connected to the body and configured to bias against a first wire and a third wire, which is parallel to the first wire, of the associated wire rack; and
- a hook member connected to one of the biasing element and the body, wherein the hook member is configured to hook a second wire, which is parallel to the first wire and the second wire, of the associated wire rack, wherein the second wire is disposed between the first wire and the third wire;
- wherein the biasing element includes a first foot adjacent a first end and a second foot adjacent a second end, wherein a lower surface of the first foot is configured to contact the first wire of the associated wire rack, wherein a lower surface of the second foot is configured to contact the third wire of the associated wire rack, wherein an upper surface of the hook member is configured to contact the second wire of the associated wire rack, wherein the lower surface of each foot is positioned below the upper surface of the hook member when the instrument stand is not secured to the associated wire rack;

wherein the hook member includes a base section contacting a lower surface of the biasing element, an arm section extending downwardly from the base section at an angle offset from vertical, and curved section extending from the arm section and configured to engage the second wire of the associated wire rack.

10. The instrument stand of claim 9, wherein the instrument stand is configured to engage the associated wire rack by moving the instrument stand in a first direction toward the associated wire rack, wherein the hook member is configured to deflect in a second direction substantially perpendicular to the first direction as a lower surface of the hook member engages the second wire and hook member deflects back in a third direction, which is opposite the second direction, when the lower surface of the hook member passes over the second wire.

11. The instrument stand of claim 9 in combination with an instrument, wherein the instrument is connected with the body.

12. The combination of claim 11, wherein the hook member is disposed at a position opposite a connection location for the instrument.

13. An instrument stand for supporting an instrument on an associated wire rack, the instrument stand comprising:

a body configured to connect to the instrument;

a biasing element connected to the body and configured to bias against a first wire and a third wire, which is parallel to the first wire, of the associated wire rack; and a hook member connected to one of the biasing element and the body, wherein the hook member is configured to hook a second wire, which is parallel to the first wire and the second wire, of the associated wire rack, wherein the second wire is disposed between the first wire and the third wire, wherein the hook member includes a base section contacting a lower surface of the biasing element, an arm section extending downwardly from the base section at an angle offset from vertical, and curved section extending from the arm section and configured to engage the second wire of the associated wire rack.

14. The instrument stand of claim 13, wherein the instrument stand is configured to engage the associated wire rack by moving the instrument stand in a first direction toward the associated wire rack, wherein the arm section of the hook member is configured to deflect in a second direction substantially perpendicular to the first direction as a lower surface of the curved section of the hook member engages the second wire.

15. The instrument stand of claim 14, the hook member is configured to deflect back in a third direction, which is opposite the second direction, when the lower surface of the curved section of the hook member passes over the second wire.

16. The instrument stand of claim 13 in combination with an instrument, wherein the instrument is connected with the body.

17. The combination of claim 16, wherein the hook member is connected to the body through the biasing element by a fastener and the hook member is disposed at a position opposite a connection location for the instrument.

18. An instrument stand for supporting an instrument on an associated wire rack, the instrument stand comprising:

a body adapted to be connected to the instrument;

a biasing element connected to the body, wherein when contacting a surface of the associated wire rack the biasing element biases the body in a direction opposite the surface, wherein the biasing element is configured to bias against a first wire and a third wire of the associated wire rack; and a hook member connected to the body through the biasing element by a connector means, wherein the hook member includes a leading face portion extending at an angle from either the biasing element or the body, and a round portion extending from the leading face portion, the round portion is adapted to hook to the associated wire rack on an arcuate surface of the round portion to thereby oppose the bias by the biasing element, wherein the hook member is configured to hookingly engage a second wire of the associated wire rack, wherein the second wire is disposed between the first wire and the third wire, wherein the leading face portion is a sloped face to deflect the hook member when engaging the surface.

19. The instrument stand of claim 18, wherein the biasing element comprises at least two legs.

20. The instrument stand of claim 18 in combination with an instrument, wherein the instrument is connected with the body.

21. The combination of claim 20, wherein the hook member is disposed at a position opposite a connection location for the instrument.

* * * * *